US005459970A

United States Patent [19]

Kim

[11] Patent Number: 5,459,970

[45] Date of Patent: Oct. 24, 1995

[54] CONCRETE STRUCTURES AND METHODS FOR THEIR MANUFACTURE

[76] Inventor: Chin T. Kim, 4323 Pearl St., Santa Monica, Calif. 90405

[21] Appl. No.: 147,396

[22] Filed: Nov. 5, 1993

[51] Int. Cl.[6] ..... E04B 2/42

[52] U.S. Cl. ..... 52/424; 52/419; 52/410; 52/379; 52/388; 52/405.1; 52/426; 52/570

[58] Field of Search ..... 52/424 OR, 419, 52/425, 410, 379, 388, 712, 405.1, 421, 427, 426, 570

[56] References Cited

U.S. PATENT DOCUMENTS

| | | | |
|---|---|---|---|
| 4,223,501 | 9/1980 | DeLozier | 52/426 X |
| 4,349,398 | 9/1982 | Kearns et al. | 52/309.12 X |
| 4,489,530 | 12/1984 | Chang | 52/309.12 X |
| 4,698,947 | 10/1987 | McKay | 52/426 X |
| 4,860,515 | 8/1989 | Browning, Jr. | 52/426 |
| 4,889,310 | 12/1989 | Boeshart | 52/426 |
| 4,924,641 | 5/1990 | Gibbar, Jr. | 52/309.12 |
| 4,936,540 | 6/1990 | Boeshart | 52/426 X |
| 5,065,561 | 11/1991 | Mason | 52/379 X |
| 5,107,648 | 4/1992 | Ruby | 52/426 |
| 5,140,794 | 8/1992 | Miller | 52/426 |

OTHER PUBLICATIONS

Advertisement brochure entitled "3L–Wall Buildings", J. Eizenberg, 4, Berezhkovsky nab., ap., 109, Moscow, 121059, Russia.

Advertisement brochure entitled "Perpetuum Module", Top Gun Co., Seoul Korea

*Primary Examiner*—Wynn E. Wood

*Attorney, Agent, or Firm*—Spensley Horn Jubas & Lubitz

[57] ABSTRACT

The present invention relates to concrete structures and methods for making walls and the like from precast concrete structures. Certain embodiments include an outer wall, and inner wall, and define a region between the walls into which reinforcing concrete may be added.

24 Claims, 6 Drawing Sheets

CONCRETE STRUCTURES AND METHODS FOR THEIR MANUFACTURE

BACKGROUND OF THE INVENTION

1. Field of the Invention

The invention relates to concrete structures and methods for making walls from concrete structures.

2. The Related Art

There are many different ways to fabricate wall structures, using such items as bricks, concrete blocks, or wooden frame construction.

For example, cement blocks with hollow passages are often used to build walls. For many commercial applications, once the blocks are built up to a certain height, such as four feet, concrete is poured into the hollow passages in the blocks to strengthen the Another four foot section is built on top of the first section, and so forth till the wall is completed. Reinforcing steel bars are usually placed within the open passages to reinforce the structure. Depending on the strength requirements for the wall, the poured concrete and steel rod reinforcement may not be needed. For example, the strength requirements for building a private house are generally less than those for commercial structures.

Constructing a wall from cement blocks as described above has several disadvantages. The process is time consuming because the many blocks used are each placed in proper alignment with those around In addition, it may be difficult to place wiring, plumbing, or insulation within the wall itself due to the structure of the blocks, which does not allow for easy access between the inner wall surface and the outer wall surface.

Furthermore, the concrete region in a block wall may not be continuous, because it may be limited to the hollow passages within each block and the concrete regions in each passage may not contact the other concrete regions. The strengthening effect of the concrete is not as great as if one continuous concrete region existed within the wall.

A typical non-commercial structure wall may include a wooden frame, together with an inner wall surface of drywall board and an outer wall surface such as stucco. To build this type of wall, wooden studs such as 2"×4"×8' studs are placed every 16" or so along the desired wall area. Then, to construct the outer wall surface, paper or wire lath is tacked to the wooden studs and an outer wall surface material such as stucco is placed onto the paper or wire mesh. Drywall sheets attached to the inside portion of the wooden beams form the inner wall surface.

This type of wooden beam wall has the advantage of allowing for relatively easy access to the region between the inner and outer wall surfaces for wiring, plumbing and insulation purposes. This type of wall construction has disadvantages. One major drawback is the time and labor necessary for fabrication of the wall. Each wooden beam must be nailed into place, then the paper or wire mesh tacked on, the outer surface stucco applied, and the inner surface drywall attached to the beams. In addition, such a wall is not particularly strong, and cannot easily be reinforced with poured concrete and reinforcing rods.

It is desirable to build walls requiring less labor than needed to build the walls described above. In addition, it is desirable Go construct a wall which can be strengthened with concrete, such that the concrete can be one continuous phase within the wall if desired. It is desirable to construct a wall in which both vertical and horizontal reinforcing bars can be easily placed within the structure.

Furthermore, it is desirable to construct a high strength wall which allows easy access to the region between the inner and outer wall surfaces for easy placement of wiring, plumbing, and insulation within the walls.

SUMMARY OF THE INVENTION

In accordance with one embodiment of the present invention, there is provided a wall structure made up of a first wall, a second wall, and connecting means between the two walls, such that there is a cavity defined within the space between the walls.

In another aspect of the present invention, the connecting means may be comprised of a first member attached to the first wall and a second member attached to the second wall, wherein the first and second members are coupled together.

In another aspect, bridging members may be placed within the first and second walls and extend into the region between the walls, such that if concrete is poured into the region between the walls, the bridging member will act to anchor the first and second walls to the poured concrete.

Another embodiment of the present invention relates to a method for constructing a structure comprising the steps of forming a first wall and attaching a first member to it, and forming a second wall and attaching a second member to it. Next the first and second members are coupled together, thus forming a wall structure which contains an open region between the first and second walls. This open region may be filled with concrete and reinforcing rods, if desired.

BRIEF DESCRIPTION OF THE DRAWINGS

Further objects, advantages and features of the present invention will become apparent from the detailed description, below, when read in conjunction with the accompanying drawings, which illustrate certain embodiments of the invention.

DETAILED DESCRIPTION OF THE PREFERRED EMBODIMENT

Figure 1:
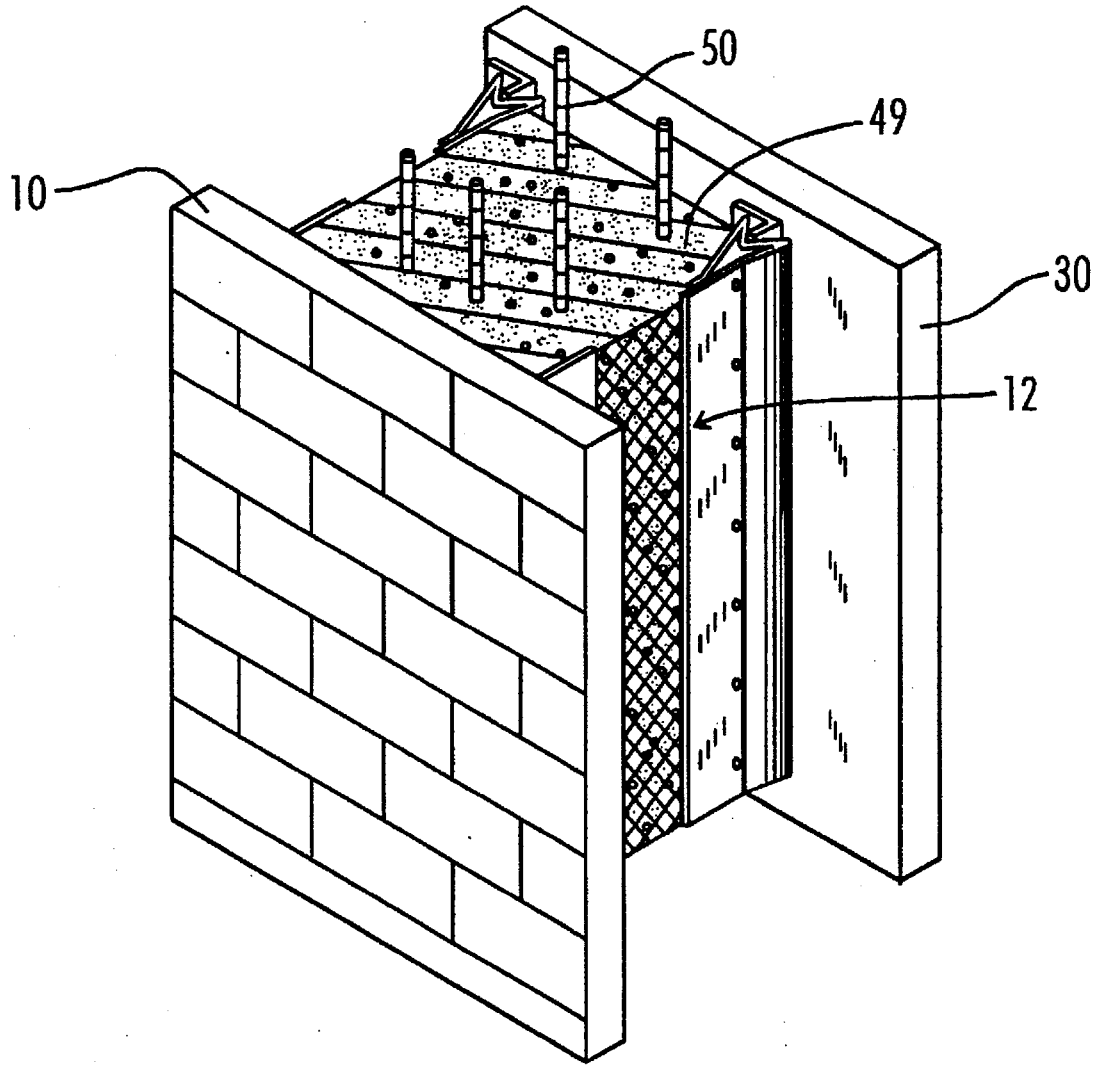
FIG. 1 is a perspective view of a section of a wall with concrete and reinforcing bars.

Referring to the drawings, FIG. 1 shows one embodiment of the present invention, wherein precast concrete wall members 10 & 30 are used to fabricate a section of wall reinforced with concrete 49 and strengthening bars 50. By precast it is meant that the walls members 10 & 30 are fabricated prior to being positioned in the structure. A plurality of wall sections can be used to build a variety of walled structures of varying heights.

Figure 2:
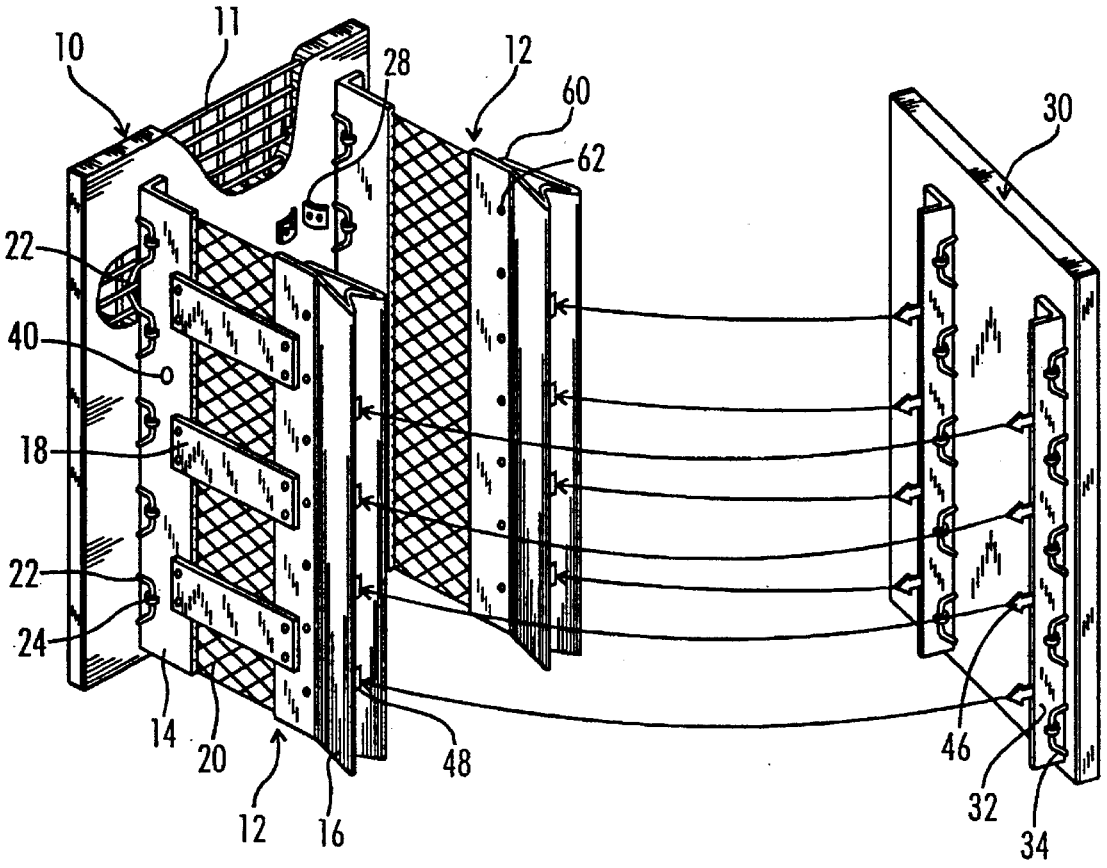
FIG. 2 is a perspective view showing how inner and outer wall portions may be connected together.

FIG. 2 shows that the walls 10 & 30 are connected together through dividing members 12 and connecting members 32. When the walls are connected together, the structure stands alone and defines a cavity between the outer wall 10 and the inner wall 30. If desired, the strength of the structure may be enhanced by pouring concrete into the cavity.

Both the outer wall 10 and the inner wall 30 may be constructed of concrete, and may contain a reinforcing screen 11 to strengthen the wall. The walls 10, 30 may be manufactured by pouring concrete into a substantially rectangular mold.

The outer wall 10 and inner wall 30 may be made to any size desired, such as four feet in width by eight feet in height by one inch thick. The size of the wall will to some extent depend on the particular structure being built and the strength requirements. In some circumstances it may be desirable to make the inner wall body smaller than the outer wall body, for example, making the outer wall four feet wide by eight feet high and making the inner wall four feet wide by four feet high. Thus two inner wall bodies are used for each outer wall piece, which allows the interior region to be built up four feet at a time. This enables building inspectors to easily inspect the structure at four foot intervals, as required in certain building codes.

In the embodiment illustrated by FIG. 2, each dividing member 12 contains an angle bracket 14, coupling flange 16 and connecting plates 18. The angle bracket 14 is the part of the dividing member 12 which is attached to the outer wall 10. The coupling flange 16 is the part of the dividing member 12 which is attached to the connecting member 32. The connecting plates 18 attach the angle bracket 14 to the coupling flange 16. The angle bracket enhances the stiffness of the dividing member 12. In addition, a mesh 20 may be included as part of the dividing member 12 between the angle bracket 14 and the coupling flange 16.

The angle bracket 14, coupling flange 16, connecting plates 18 and mesh sections 20 of the dividing member 12 may appear as in FIG. 2, or may have other forms or geometries. For example, the bracket may have no right angle bend, and could itself be embedded in the outer wall 10. Because the right angle bend portion adds stiffness to the dividing member 12, if no right angle bend portion is used, a stiffening piece may be attached to the dividing member to increase the dividing member stiffness. In applications where stiffness is not required, however, bracket 14 may be formed without an angle on the stiffening piece.

In addition, the angle bracket 14, coupling flange 16, connecting plates 18 may be part of the same sheet and thus form one continuous plate. Similarly, the mesh 20 may be machined from the same sheet as well.

The dividing members 12 may be attached to the outer wall 10 through various means, including a wire 22 which is partially embedded in the outer wall 10 when the wall is cast and attached to the dividing member 12. Alternatively the dividing members may themselves be partially embedded in the outer wall. If the dividing member itself is embedded within the wall, various geometries and attachments may be incorporated into the part of the dividing member which is embedded in the wall. For example, holes may be incorporated into the part of the dividing member which is to be embedded in the wall, to enable concrete to flow through the holes and create a strong bond between the dividing member and the concrete.

Figure 7:
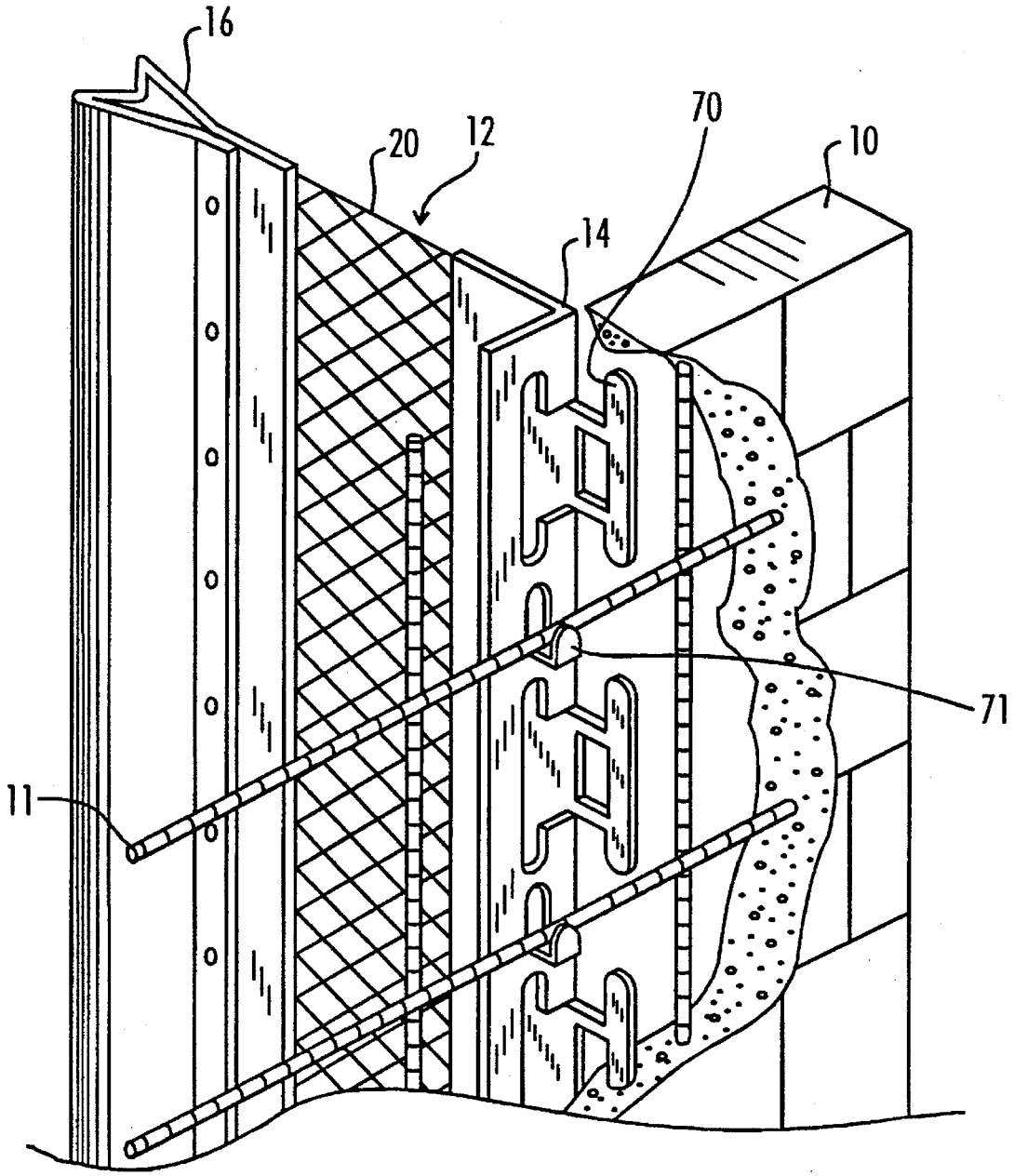
FIG. 7 shows an embodiment including portions of the dividing member embedded into the outer wall.

FIG. 7 shows an embodiment in which the dividing member 12 is partially embedded in the outer wall 10. Tabs 70 are cut from the angle bracket 14 portion of the dividing member 12 and embedded within the outer wall 10, in order to attach the dividing member 12 to the outer wall. The tabs 70 have an outer region defining a hole to allow concrete to pass through the tab and ensure a good connection between the tab and concrete in the wall. In such an embodiment a wire 22 need not be used to attach the dividing member 12 to the outer wall 10. Such tabs 70 could also be cut from connecting member 32 and embedded into the inner wall 30. The tabs may have a variety of geometries.

In embodiments using a wire 22 to attach the dividing member 12 to the outer wall 10, the means for attaching the wire 22 to the dividing member 12 may vary, and may include forming a tab 24 on the solid section 14 of the dividing member 12, then folding the tab 24 over the wire 22, thus clamping the wire 22 to the dividing member 12. Other potential means for attaching the wire 22 to the dividing member 12 include welding or any other conventional method for attaching a wire to a plate. For good mechanical properties and long life, the wire may be constructed of stainless steel, or any other desirable material.

Figure 3:
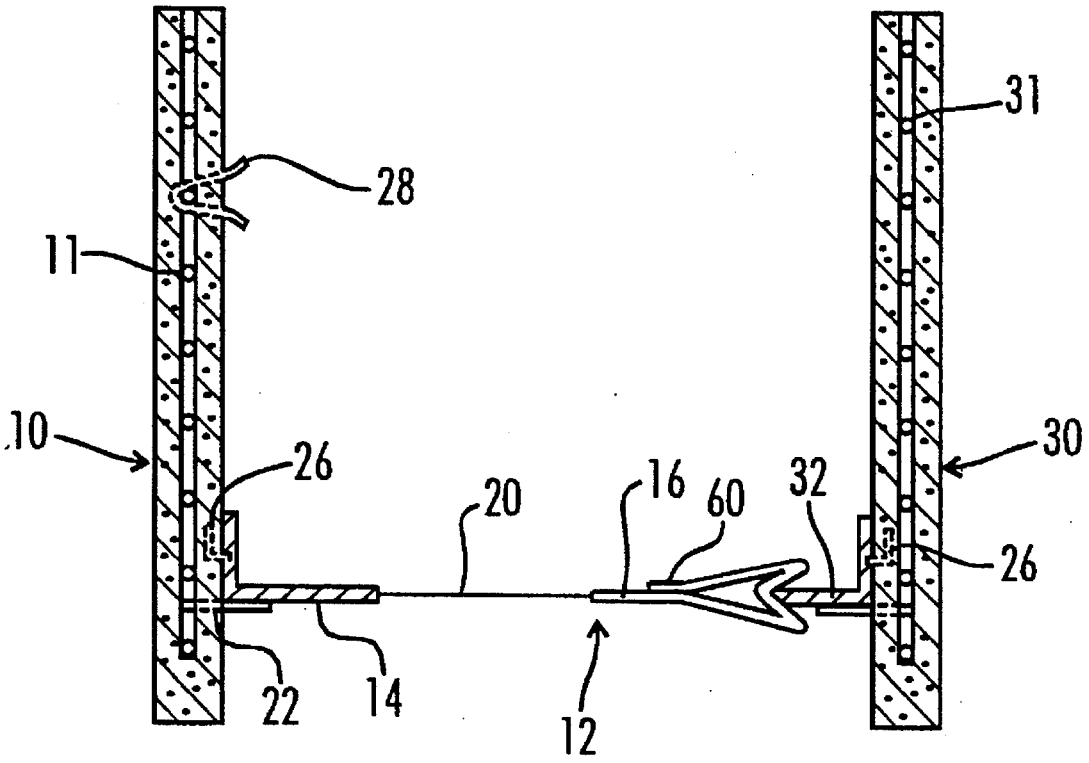
FIG. 3 is a top plan view of a wall and some of its various components.

As seen in the top plan view of FIG. 3, another set of tabs 26 with a right angle bend may be formed on the angle bracket portion of the dividing member 12 and/or the connecting member 32. These tabs 26 are embedded into the outer wall 10 and/or inner wall 30, thus strengthening the connection below the member and the wall.

Bridging member 28 may be used in certain embodiments of the invention. The bridging member 28 extends from the outer wall 10 or inner wall 30 into the cavity defined between the two walls. Concrete 49 is poured into the cavity between the walls to complete the wall assembly. As the concrete 49 dries, it solidifies around the bridging member 28 and in contact with the outer wall 10 and inner wall 30. The bridging member 28 embedded within the solidified concrete 49 holds the wall fixed against the solidified concrete and adds rigidity to the entire wall assembly.

In certain embodiments, the bridging member 28 may be partially implanted within the outer wall 10 and surround the reinforcing screen 11. In other embodiments the bridging member need not surround the reinforcing screen. In still other embodiments, the bridging member may be used when there is no screen in the wall. The bridging member 28 may have the form shown in FIG. 5*a* (straight sides) or in FIG. 5*b* (bent sides). Numerous other forms may also be utilized for the bridging member 28, provided that the bridging member is attached to the inner or outer wall and extends into the region between the inner and outer walls. Other forms the bridging member could take include members having only one portion or more than two portions extending into the region between the walls. Alternatively the bridging member could extend from within a wall to the region between the walls and then back within the same wall.

Both or either of the walls 10 & 30 may have bridging members 28 incorporated into it, and any number of bridging members 28 may be placed within a wall, for example, they may be placed every one foot in height and every two feet along the length of the wall.

Figure 5A:
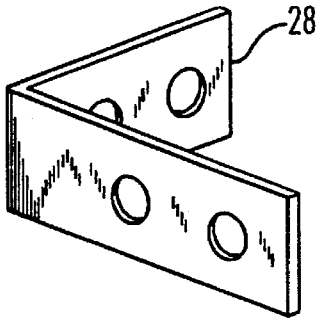
FIGS. 5*a* and 5*b* shows bridging members used to help anchor the inner and/or outer walls to a poured concrete region.
Figure 5B:
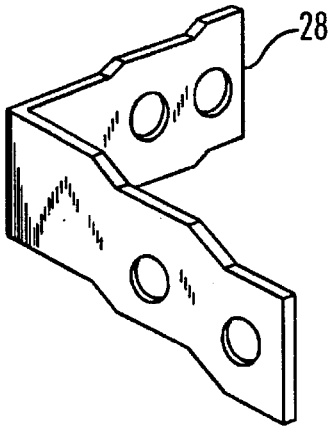

In another aspect, the bridging member 28 may have holes 29 as seen in FIG. 5*a* and 5*b* which allow concrete to pass through the member, providing a stronger connection. In many embodiments, a plurality of bridging members 28 is preferred in order to insure good adhesion between the walls 10 & 30 and the concrete 49 between them.

In certain embodiments the bridging members 28 are also used to facilitate the construction of the outer wall 10 and inner wall 30 be acting to hold the strengthening screen 11 in place as the concrete 49 is poured and hardens.

The embodiment of the outer wall 10 shown in FIG. 2 may be constructed as follows. First dividing members 12 with attached wires 22 and with tabs 26 are attached to a wooden mold frame such that part of the wires 22 and the tabs 26 are protruding into the mold area of the frame. A screen 11 with bridging members 28 is set within the mold, with the bridging members 28 pinched around the screen and holding the screen above the bottom surface of the mold. The bridging members 28 may extend to the bottom of the mold and may have ends bent to be parallel to and extend along the bottom surface of the mold. Next, concrete is poured into the mold.

When the concrete hardens and the mold is removed, a wall is formed with wire 22, tabs 26, screen 11 and bridging members 28 all embedded within the concrete. The ends of the bridging members will extend along the surface of the wall and parallel to the wall. These ends of the bridging members may then be bent out from the surface of the wall, thus yielding an outer wall 10 with protruding bridging members 28 such as that shown in FIGS. 2 and 3.

As shown in FIG. 7, the screen 11 may also be held in place by the use of supports 71 cut from the dividing member 12. In addition, the mesh size of the screen 11 may vary considerably.

The inner wall 30 may be constructed using a technique similar to that used to construct the outer wall 10.

As shown in FIGS. 1 and 2, certain embodiments of the present invention include two dividing members 12. Concrete 49 may be poured between the inner wall 30 and outer wall 10 to strengthen the entire wall structure. The mesh 20 area of the dividing member 12 is constructed to restrict the flow of concrete 49. However, the flow of concrete will not be completely restricted. The mesh 20 may be constructed so that if concrete is poured on both sides of the mesh 20, there will be enough contact between the concrete on both sides of the mesh 20 to create a continuous concrete structure which enhances the mechanical properties of the wall.

Figure 6:
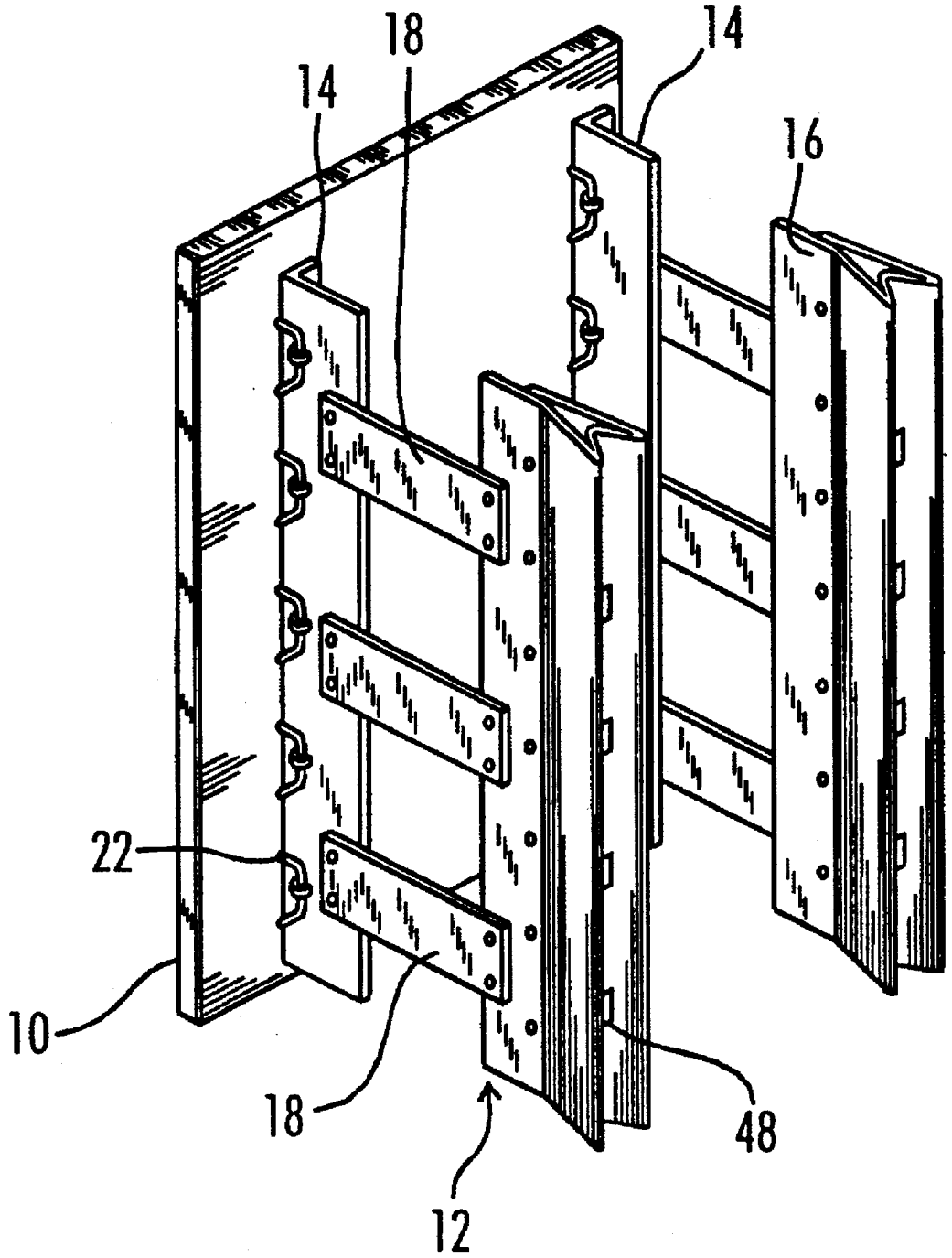
FIG. 6 shows an embodiment including dividing members with connecting plates.

FIG. 2 shows an embodiment of the present invention where the dividing members 12 include mesh 20 and plates 18. This invention allows for the use of either the plates 18 or the mesh 20, or both together. For example, if adjoining sections are to be filled with concrete, plates 18 may be used because there is no need to restrict the flow of concrete between adjoining sections. In addition, it is desirable to use the plates 18 because they are more stiff than the mesh 20 and will create a more rigid structure. An embodiment of the present invention using plates 18 is shown in FIG. 6.

In addition, holes 40 may be placed in the dividing members 12 in order to allow concrete to flow into adjoining sections if desired.

Alternatively, as shown in FIG. 1, if concrete is not to be poured into adjacent sections, then the mesh may be used to restrict the flow and prevent significant amounts of concrete from entering the adjoining section.

Other embodiments of the present invention may have, for example, four dividing members and connecting members within each wall section. In such a structure, concrete could be poured into alternate regions between the dividing members, thus creating discrete concrete members within the wall.

The connecting members 32 may include an angle bracket region, and may be attached to the inner wall 30 using a wire 34 or other method in the same way that the dividing members 12 are attached to the outer wall 10. Tabs 36 similar to tabs 24 may be used, as well as tabs 38, which are similar to tabs 26.

The connecting members 32 have coupling means which are attached to the dividing members 12. Such coupling means may include a substantially wedge or arrow shaped protuberance 46 which extends from the connecting member. Each arrow shaped protuberance 46 fits into an opening 48 in the coupling flange 16 region of the dividing member 12 to form an interlocking joint holding the connecting member 32 to the dividing member 12. Other connection means, including but not limited to different shaped protuberances, clips, bolts, or even welding could be used, though a non-permanent connection is usually preferred to allow for removal if the need arises.

As shown in FIG. 2 and 3, the coupling flange 16 of the dividing member 12 may be bent so as to form a substantially V-shaped crevice, the V-shaped crevice having openings 48 incorporated into it, the openings shaped so as to accept the wedge-shaped section 46 of the connecting member 32 as described above. The edge 60 of the coupling flange 16 is bent so that it comes into contact with another portion of the second solid area as shown in FIGS. 1 and 2. Spot welds 62 may then be used to insure that the edge 60 remains attached. Means other than spot welding, such as bolts, could also be used.

In an embodiment of the present invention, the dividing members, connecting members, and bridging members may in some embodiments preferably be constructed from galvanized steel, which provides protection from corrosion. Alternatively, materials including, but not limited to other metals and polymers could be used. In addition, the inner and outer walls could also be constructed from materials other than concrete, including, but not limited to, polymers. The choice of material for the various parts of the present invention generally depends on factors such as cost and strength.

Figure 4:
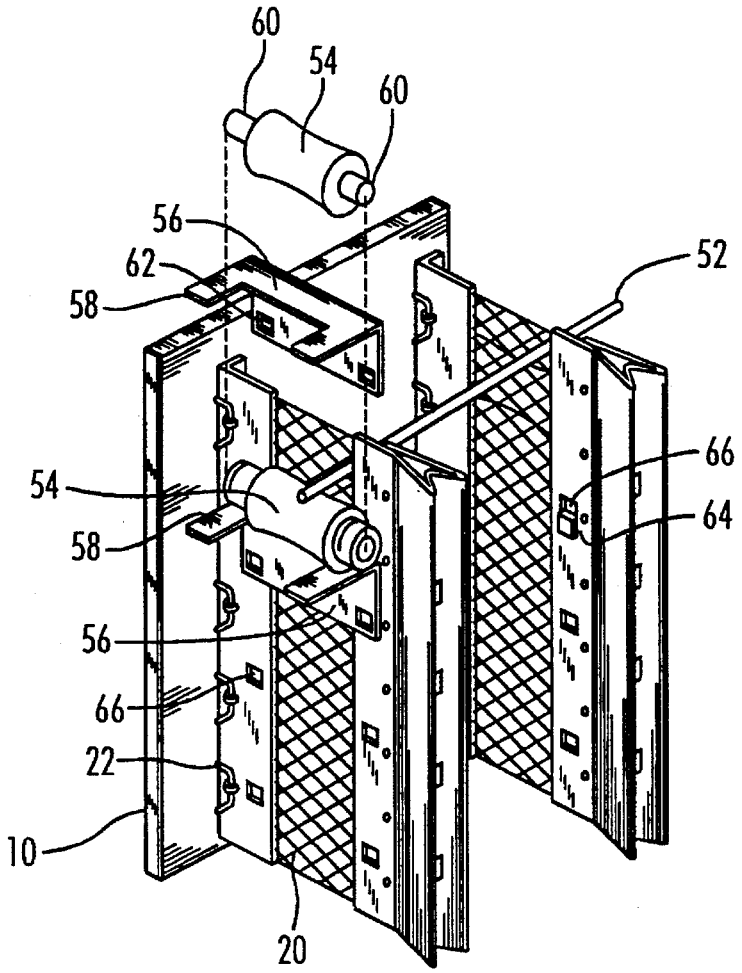
FIG. 4 is perspective view showing the placement of a horizontal reinforcing bar.

Any number of reinforcing bars 50, typically made from steel, may easily be used in the present invention if necessary. FIG. 1 shows the appearance of vertical reinforcing bars 50. FIG. 4 shows a view of one means for holding a horizontal reinforcing bar 52 in place according to the present invention. A roller 54 with a rod 60 may be mounted on a small metal frame 56, the frame 56 having bendable tabs 58 which can be bent over the sides of rod 60, thus holding the roller 54 to the frame 56. A small opening or slot 66 may be cut into the dividing member 12. Connecting tabs may be cut into the frame 56, such that the frame has a protrusion 64 which can be fit into the slot cut into the dividing member 12. The advantage of the roller mechanism is that the bar 52 can easily be slid into place.

Other methods could also be used to attach the roller 54 to the dividing member, such as running a wire through the roller and through holes in the dividing member, clipping, bolting, or welding. In one embodiment, the roller is constructed from a polymer, and the rod and rest of the frame from a metal, such as stainless steel for the rod and galvanized steel for the frame. Other materials may also be used for the roller, rod and frame.

Alternatively, the roller need not be used, because the horizontal reinforcing bar could rest on the connecting plates 18 in the dividing member 12, or holes could be cut through the dividing member 12 into which the reinforcing bar could be placed.

In addition to walls built for houses and buildings, the present invention may also be used to construct other structures, including sound barriers, retaining walls, or fences.

Walls built according to the present invention are inexpensive and can be built quickly, because there are no blocks to lay, and no hammering of wooden studs every sixteen inches to create a frame. Little or no heavy equipment is needed, and large sheets may be easily maneuvered into place. Concrete with steel reinforcing bars may be used when necessary to increase the strength of the wall. If desired, poured concrete may be used in some regions of the wall, and not in others. The size of the concrete areas may vary as well, because any number of dividing members and connecting members may be attached to the walls. In one preferred embodiment, as shown in FIG. 1, there are two dividing members 12 and two connecting members 32. Another preferred embodiment has four dividing members and four connecting members within each section. In another embodiment, the dividing members 12 and connecting members 32 are spaced at equal distances from the ends of each wall piece, which enables the walls to be turned upside down and used.

In addition, easy access to the interior area within the wall is allowed prior to pouring in concrete, thus enabling insulation, plumbing, and wiring to be easily and inexpensively installed.

Furthermore, the outer wall 10 and inner wall 30 may be textured, painted, or coated so as to create any appearance desired, such as a tile or brick face appearance (see FIGS. 1 and 7).

As a result, the scope of the present invention extends to a variety of structures, materials, and methods of fabrication as disclosed above.

The discussion above describes the best mode contemplated for carrying out the present invention. This description illustrates the principles of the invention and should not be taken in a limiting sense. The scope of the invention should be determined by reference to the appended claims.

What is claimed is:

1. A structure comprising:

a first precast wall;

a second precast wall;

connecting means between the first and second precast walls, wherein the connecting means comprises a first member attached to the first precast wall and a second member attached to the second precast wall, wherein the first and second members are coupled together;

the first member comprising a first bracket and connecting flange;

the second member comprising a second bracket and coupling means;

wherein a first wire attaches the first member to the first precast wall, wherein part of the first wire is embedded in the first precast wall and part of the first wire is connected to the first member;

and wherein the structure defines at least one cavity between the first precast wall and the second precast wall.

2. A structure as in claim 1, wherein a second wire attaches the second member to the second precast wall, wherein part of the second wire is embedded in the second wall and part of the second wire is connected to the second member.

3. A structure as in claim 1, wherein:

the second member includes coupling means comprising a plurality of protuberances;

the first member includes a connecting flange comprising a plurality of openings sized to fit the protuberances; and the protuberances are inserted into the openings in order to connect the first member and the second member together.

4. A structure as in claim 1, wherein the first member further comprises at least one plate disposed between the first bracket and the connecting flange.

5. A structure as in claim 1, further comprising concrete disposed within at least one cavity between the first precast wall and the second precast wall.

6. A structure as in claim 1, wherein a screen is embedded within at least one of the precast walls.

7. A structure as in claim 6, wherein a support extends from one of the first and second members into the at least one of the precast walls and engages a portion of the screen.

8. A structure as in claim 1, wherein at least one of the first and second members has at least one tab extending into at least one of the first and second precast walls.

9. A structure as in claim 8, wherein the at least one tab includes an aperture extending through the tab, wherein material of the precast wall is disposed within the aperture of the tab to bond the tab to the precast wall.

10. A structure comprising:

a first precast wall;

a second precast wall;

connecting means between the first and second precast walls, wherein the connecting means comprises a first member attached to the first precast wall and a second member attached to the second precast wall, wherein the first and second members are coupled together;

the first member comprising a first bracket and connecting flange;

the second member comprising a second bracket and coupling means;

wherein a wire attaches the second member to the second precast wall, wherein part of the wire is embedded in the second precast wall and part of the wire is connected to the second member;

and wherein the structure defines at least one cavity between the first precast wall and the second precast wall.

11. A structure comprising:

a first precast wall;

a second precast wall;

a first member comprising a first bracket portion, a mesh portion, and a connecting portion; and a second member, wherein the first member is attached to the first precast wall and the second member is attached to the second precast wall and the first and second members are coupled together, and wherein the structure defines at least one cavity between the first precast wall and the second precast wall.

12. A structure as in claim 11 wherein the first member further comprises at least one plate disposed between the first bracket portion and the connecting portion.

13. A structure comprising:

a first precast wall;

a second precast wall;

connecting means between the first precast wall and the second precast wall, wherein the connecting means comprises a first member attached to the first precast wall and a second member attached to the second precast wall, wherein the first member and the second member are coupled together;

a roller for holding a reinforcing bar in a substantially horizontal direction within a space defined by the first precast wall and the second precast wall; and wherein the structure defines at least one cavity between the first precast wall and the second precast wall.

14. A structure comprising:

a first wall;

a second wall;

at least two members, wherein a first member is attached to the first wall and a second member is attached to the second wall, wherein at least one member further comprises a mesh region;

a wire, wherein the wire attaches the first member to the first wall, wherein part of the wire is attached to the first wall and part of the wire is attached to the first member;

wherein the first and second members are attached together; and wherein a cavity is defined between the first wall and the second wall.

15. A structure as in claim 14, further comprising a wire for attaching the second member to the second wall, wherein part of the wire is attached to the second precast wall and part of the wire is attached to the second member.

16. The structure of claim 14, wherein at least one of the first and second members has at least one tab extending from the member into one of the first and second walls.

17. The structure of claim 14, wherein at least a portion of the first member is partially embedded in the first wall.

18. The structure of claim 14, wherein a screen is embedded within at least one of the first and second walls.

19. The structure of claim 14, wherein:

the first member includes a substantially Y-shaped flange, the flange including a plurality of openings;

the second member includes a plurality of arrow-shaped protuberances; and wherein individual protuberances are disposed within individual openings in the flange.

20. The structure of claim 14, further including at least one roller disposed between the first and second walls so that the axis of the roller is substantially perpendicular to the plane of the first and second walls, wherein a reinforcing bar may be placed on the roller and inserted into the cavity between the walls and supported in a substantially horizontal position.

21. The structure of claim 14, further comprising concrete disposed within the cavity, wherein at least one of the first and second walls includes a bridging member, the bridging member being partially embedded in the at least one of the first and second walls and partially extending into the cavity defined by the first and second walls; and wherein the bridging member provides a connection between the at least one of the first and second walls and the concrete disposed within the cavity.

22. A structure comprising:

a first wall;

a second wall;

at least two members for attaching the first wall and the second wall together, wherein a first member is attached to the first wall and a second member is attached to the second wall, wherein a cavity is defined between the first wall and the second wall;

at least one roller disposed in the cavity between the first wall and the second wall, the roller disposed between the first and second walls so that the axis of the roller is substantially perpendicular to the plane of the first and second walls; and at least one reinforcing bar disposed in the cavity between the first wall and the second wall, wherein the at least one reinforcing bar is supported in a substantially horizontal position by the at least one roller.

23. A structure as in claim 22, further comprising a wire, wherein a portion of the wire is embedded in the first wall and a portion of the wire is attached to the first member.

24. A structure as in claim 23, wherein:

the first member includes a substantially Y-shaped flange, the flange including a plurality of openings;

the second member includes a plurality of arrow-shaped protuberances; and wherein individual protuberances are disposed within individual openings in the flange.

* * * * *